United States Patent [19]

Carver

[11] 4,242,095

[45] Dec. 30, 1980

[54] YARN LUBRICANTS

[75] Inventor: Bobby C. Carver, Kingsport, Tenn.

[73] Assignee: Eastman Kodak Company, Rochester, N.Y.

[21] Appl. No.: 100,582

[22] Filed: Dec. 5, 1979

[51] Int. Cl.[3] ..... D06M 00/00

[52] U.S. Cl. ..... 8/115.6; 252/8.6; 252/8.9

[58] Field of Search ..... 8/115.6; 252/8.9

[56] References Cited

U.S. PATENT DOCUMENTS

| | | | |
|---|---|---|---|
| 3,338,830 | 8/1967 | Stokes et al. | 252/8.7 |
| 4,169,061 | 9/1979 | Carver et al. | 8/115.6 |

*Primary Examiner*—A. Lionel Clingman

*Attorney, Agent, or Firm*—William P. Heath, Jr.; Daniel B. Reece, III

[57] ABSTRACT

Yarn lubricant and yarns lubricated therewith, the lubricant comprising an admixture of butyl stearate, POE(5) lauryl potassium phosphate, POE(30) castor oil, sodium dodecylbenzene sulfonate, POE(8) dinonylphenol and ethoxylated-propoxylated butyl alcohol.

10 Claims, No Drawings

YARN LUBRICANTS

DESCRIPTION

1. Technical Field

This invention relates to a new composition of matter and articles produced therewith. It is particularly concerned with textile lubricant compositions especially useful in the manufacture of draw textured yarns. The lubricant composition is made up of a mixture of butyl stearate, POE(5) lauryl potassium phosphate, POE(30) castor oil, sodium dodecylbenzene sulfonate, POE(8) dinonylphenol and ethoxylated-propoxylated alcohol. This lubricant composition when used on partially oriented polyester feed yarn results in a dramatic reduction of broken filaments when the yarn is processed by conventional draw-texture processes.

2. Background Art

Lubricant compositions made up of butyl stearate, POE(5) lauryl potassium phosphate, POE(30) castor oil, sodium dodecylbenzene sulfonate and POE(8) dinonylphenol are in commercial use as lubricants on polyester weaving yarn. When these compositons are used in draw-texture applications the occurrance of broken filaments per pound of textured yarn is higher than desired. The yarns having occurrences of broken filaments, when converted into fabrics, result in fabrics having defects.

Another lubricant composition now in commercial use for draw texturing applications is made up of 9 weight percent ethoxylated silicone fluid; 8 weight percent petroleum sulfonates; 8 weight percent triethanolamine oleate; 24 weight percent POE(16) castor oil; 50 weight percent $C_8$–$C_{10}$ ester of trimethylopropane; and 1 weight percent polydimethylsiloxane.

U.S. Pat. No. 3,338,830 discloses the use of an ethoxylated-propoxylated alcohol, as one component of a lubricant composition for draw-texture feed yarns.

DISCLOSURE OF THE INVENTION

This invention relates to lubricant compositions especially suited for use in draw-texturing operations on polyester filament yarns. It is theorized that broken filaments in draw-textured yarns may be caused by high fiber-to-fiber friction which does not allow satisfactory migration of the filaments from the inside to the outside of a yarn bundle during the texturing operation.

I have found that lubricant compositions applied as an aqueous emulsion containing butyl stearate and ethoxylatedpropoxylated alcohol and suitable emulsifying agents and anti-static agents result in greatly improved texturing performance in the reduction of broken filaments per pound of textured yarn. This lubricant composition is especially useful on yarns such as partially oriented poly(ethylene terephthalate) feeder yarns of higher deniers, for example a 48 filament, 260 undrawn denier which is to be drawn down to 150 denier yarn, the filaments having a round cross-section.

The ethoxylated-propoxylated alcohol is a random copolymer of ethylene oxide and propylene oxide (75/25 to 25/75 ratio weight basis) reacted with an alcohol having 1 to 16 carbon atoms.

More particularly, the lubricant composition may comprise butyl stearate (about 30 to 70 weight percent); POE(5) lauryl potassium phosphate (about 1 to 10 weight percent); POE(30) castor oil (about 5 to 35 weight percent); sodium dodecylbenzene sulfonate (about 1 to 10 weight percent); POE(8) dinonylphenol (about 10 to 40 weight percent); and ethoxylated-propoxylated butyl alcohol (about 1 to 35 weight percent) prepared by reacting butyl alcohol with a 5050 mixture of ethylene and propylene oxide and having a viscosity of about 5100 at 100° F. in Saybolt Universal Seconds (SUS).

In the preferred embodiment of my invention the several components are present in the following amounts: butyl stearate 49.5%; POE(5) lauryl potassium phosphate 1.8%; POE(30) castor oil 13.5%; sodium dodecylbenzene sulfonate 2.7%; POE(8) dinonylphenol 22.5% and ethoxylated-propoxylated butyl alcohol 10.0%.

This invention will be further illustrated by the following example although it will be understood that this example is included merely for purposes of illustration and is not intended to limit the scope of the invention.

EXAMPLE

Poly(ethylene terephthalate) feeder yarns 260(150)/48 round cross-section were prepared and lubricated with the use of an oil roll with the compositions as indicated later herein. The yarns were draw-textured on double heater Scragg Mark 8 friction twist machines with ceramic discs at 600 meters/minute. Two runs were made to compare the performance of yarn lubricated with the lubricant composition of my invention (Run A) with the same yarn lubricated with known commercial texturing lubricants (Run B and Run C).

Run A was lubricated with an aqueous emulsion of the following composition at the target level of 0.35 to 0.40 weight percent lubricant. The lubricant composition made up 49.5 weight percent of butyl stearate; 1.8 weight percent of POE(5) lauryl potassium phosphate; 13.5 weight percent of POE(30) castor oil; 2.7 weight percent of sodium dodecylbenzene sulfonate; 22.5 weight percent of POE(8) dinonylphenol; and 10.0 weight percent of ethoxylated-propoxylated butyl alcohol, SUS viscosity of 5100 at 100° F.

Run B was lubricated with an aqueous emulsion of the following composition at the target level of 0.35 to 0.40 weight percent lubricant. The lubricant composition was made up of 75 weight percent ethoxylated-propoxylated butyl alcohol, SUS viscosity of 100 at 100° F.; 20 weight percent of ethoxylatedpropoxylated butyl alcohol, SUS viscosity of 5100 at 100° F.; 2 weight percent of sodium dodecyl benzene sulfonate; and 3 weight percent of POE(8) dinonylphenol potassium phosphate.

Run C was lubricated with an aqueous emulsion of the following composition at the target level of 0.35 to 0.40 weight percent. The lubricant composition was made up of 9 weight percent ethoxylated silicone fluid; 8 weight percent petroleum sulfonate; 8 weight percent triethanolamine oleate; 24 weight percent POE(16) castor oil; 50 weight percent $C_8$–$C_{10}$ ester of trimethylopropane; and 1 weight percent polydimethylsiloxane.

Run A averaged 0.4 broken filaments per pound of yarn in the first run and 0.8 broken filaments per pound of yarn in the second run.

Run B averaged 7.0 broken filaments per pound of yarn in the first and second runs.

Run C averaged 10 broken filaments per pound of yarn in both the first and second runs.

This example illustrates the excellent performance of the yarns lubricated with a composition of this invention as compared to two commercial lubricants presently in use as texturing lubricants for poly(ethylene terephthalate) feed yarns for draw-texturing operations.

The ethoxylated-propoxylated butyl alcohol used in the several formulations in a random copolymer of ethylene oxide and propylene oxide (50/50 ratio weight basis) reacted with butyl alcohol. The final product is polymerized to a desired final viscosity. In the instances used herein, the Saybolt Universal Seconds (SUS) at 100° F. were 100 and 5100 as indicated.

The component referred to as triethanolamine oleate in Run C was a combination of oleic acid and triethanol amine reacted in about a 2:1 ratio.

The invention has been described in detail with particular reference to preferred embodiments thereof, but it will be understood that variations and modifications can be effected within the spirit and scope of the invention.

I claim:

1. Fiber lubricant composition comprising butyl stearate, ethoxylated-propoxylated alcohol having a SUS viscosity of 1,000 to 20,000 at 100° F. and prepared from a blend of ethylene oxide and propylene oxide reacted with an alcohol having 1 to 16 carbon atoms and effective amounts of emulsifying agents and antistatic agents.

2. Fiber lubricant of claim 1 wherein the ethylene oxide and propylene oxide is a 50:50 blend and is reacted with butyl alcohol and has a SUS viscosity at 100° F. of about 5100.

3. Fiber lubricant composition of claim 1 wherein the components are 30 to 70 weight percent of butyl stearate, 1 to 35 weight percent of ethoxylated-propoxylated butyl alcohol having a SUS viscosity of 5100 at 100° F., 1 to 10 weight percent of POE(5) lauryl potassium phosphate, 3 to 35 weight percent of POE(30) castor oil, 1 to 10 weight percent of sodium dodecylbenzene sulfonate, and 10 to 40 weight percent of POE(8) dinonylphenol.

4. Fiber lubricant composition of claim 3 wherein the butyl stearate is present in the amount of 49.5 weight percent, the ethoxylated-propoxylated butyl alcohol in the amount of 10 weight percent, the POE(5) lauryl potassium phosphate in the amount of 1.8 weight percent, the POE(30) castor oil in the amount of 13.5 weight percent, the sodium dodecylbenzene sulfonate in the amount of 2.7 weight percent, and the POE(8) dinonylphenol in the amount of 22.5 weight percent.

5. Feeder yarn lubricated with the lubricant composition of claim 1.

6. Feeder yarn lubricated with the lubricant composition of claim 2.

7. Feeder yarn lubricated with the lubricant composition of claim 3.

8. Feeder yarn lubricated with the lubricant composition of claim 4.

9. Poly(ethylene terephthalate) feeder yarn lubricated with the composition of claim 3.

10. Poly(ethylene terephthalate) feeder yarns lubricated with the composition of claim 4.

* * * * *